US006848927B2

(12) United States Patent
Shirai

(10) Patent No.: US 6,848,927 B2
(45) Date of Patent: Feb. 1, 2005

(54) CARD CONNECTING STRUCTURE AND CARD CONNECTOR USED IN THE SAME

(75) Inventor: Hiroshi Shirai, Saitama (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/646,669

(22) Filed: Aug. 22, 2003

(65) Prior Publication Data

US 2004/0038566 A1 Feb. 26, 2004

(30) Foreign Application Priority Data

Aug. 23, 2002 (JP) ..... 2002-243394

(51) Int. Cl.[7] ..... H01R 13/62
(52) U.S. Cl. ..... 439/326; 439/328
(58) Field of Search ..... 439/326, 325, 439/328

(56) References Cited

U.S. PATENT DOCUMENTS 3,327,278 A * 6/1967 Siegfried ..... 439/44
3,701,071 A * 10/1972 Landman ..... 200/5 R
5,184,961 A * 2/1993 Ramirez et al. ..... 439/59
5,769,668 A * 6/1998 Tondreault ..... 439/633
5,839,913 A * 11/1998 Fumikura ..... 439/326
5,997,332 A * 12/1999 Choy ..... 439/328
6,042,411 A * 3/2000 Choy ..... 439/328
6,183,283 B1 * 2/2001 Kurotori et al. ..... 439/326
6,419,513 B1 * 7/2002 Choy ..... 439/326

FOREIGN PATENT DOCUMENTS

JP 9-82429 3/1997 ..... H01R/23/68
JP 09082429 A 3/1997 ..... H01R/23/68

* cited by examiner

*Primary Examiner*—Hae Moon Hyeon
(74) *Attorney, Agent, or Firm*—Barley Snyder

(57) ABSTRACT

The object of the present invention is to provide a card connecting structure and a card connector used in the same which have a minimum width that allows the guidance of the card at the time of insertion and the fastening of the received card, and that makes it possible to satisfy specifications in which space for fastening is not provided on both sides of the card, and which can sufficiently protect the solder-connected parts of the contacts. The card connecting structure comprises a card 40 that has contact pads 41 on one end, and a card connector 1 that receives this end of the card 40. Fastening means 50 that fasten the card 40 to the circuit board are disposed on the other end of the card 40 from the contact pads. Metal guide members 30 that guide the card 40 are disposed on both sides of the housing 10 (in the lengthwise direction) of the card connector 1. Each of the guide members 30 comprises a flat-plate-form guide part 31 which guides the card 40, a fastening part 32 which is fastened to the housing 10, and a soldered part 33 which is disposed between the guide part 31 and the fastening part 32, and which is soldered to the circuit board.

12 Claims, 5 Drawing Sheets

Prior Art

CARD CONNECTING STRUCTURE AND CARD CONNECTOR USED IN THE SAME

FIELD OF THE INVENTION

The present invention relates to a card connecting structure which is used to connect a card such as a memory module to a circuit board.

BACKGROUND OF THE INVENTION

It is often desireable to connect cards such as memory modules to circuit boards in personal computers and the like. Typically, a card connector is used to make such connections.

For example, a card connector 100, shown in FIGS. 6A and 6B, connects a card such as a memory module to a circuit board.

As is shown in FIG. 6(A), this card connector 100 comprises an insulating housing 110 defining a card receiving recess (not shown in the figure), a plurality of contacts 120 attached to the housing 110 in two rows and configured to make electrical contact with contact pads (not shown in the figure) on a card C that is received in the card receiving recess, and a pair of metal members 130 that are attached to the housing 110 (one on each side of the card receiving recess in the lengthwise direction). Each contact 120 is connected to a circuit board (not shown in the figure) via a lead 121, with each lead 121 being soldered to a boss or pad (not shown in the figure) on the circuit board. Each metal member 130 has a latch 131 for latching the card C in the connector 100 after it is received in the card receiving recess. A fastener 132 extends from each metal member 130 and is soldered to the circuit board. The fastener 132 is soldered to the circuit board to protect the leads 121 of the contacts 120 from mechanical stress.

As is shown in FIG. 6(B), the card C is inserted into the card receiving recess of the card connector 100 at an inclination, then rotated in the direction indicated by arrow A. Rotation of the card C temporarily displaces metal parts 130 outwardly, as shown in FIG. 6B. The card C is latched by the latches 131 such that the card C and the circuit board are parallel. In the latched position, the card C is restricted from moving in the upward direction and in the rearward direction (the direction in which the card C slips out of the card connector). Also, when the card C is latched in the card receiving recess, the respective contacts 120 make physical contact with the contact pads of the card C, so that the card C is electrically connected to the circuit board via the contacts 120.

The card connector 100 shown in FIG. 6, however, requires clearance on both sides of the connector to accommodate the outward displacement of metal parts 130. Also, since the lead fasteners 132 disposed on the metal members 130 are located in positions that are widely separated from the leads 121 of the contacts 120, the ability of the fasteners 132 to prevent stress on the leads 121 of the contacts 120 is reduced.

SUMMARY OF THE INVENTION

In an exemplary embodiment, the present invention provides a card connecting structure and card connector used therein, which require a minimum width for the guidance of the card at the time of insertion and the fastening of the received card. Also, the connector of the present invention does not require space for fastening the card to be provided on both sides of the card. Additionally, in an exemplary embodiment, the connector of the present invention can sufficiently protect leads of the contacts from mechanical stress.

According to an exemplary embodiment of the present invention, a card connecting structure comprises a card that has contact pads on one end thereof, and a card connector that receives this end of the card. The card connector comprises a housing configured to receive one end of the card, and contacts that are attached to the housing. The contacts have contact surfaces for contacting the contact pads of the card and leads that are soldered to a circuit board on which the card connector is mounted. Fastening means for fastening the card to the circuit board are disposed on the card at an end opposite the contact pads. Metal guide members which guide the card are disposed on both ends of the housing in the lengthwise direction. Each of the guide members comprises a flat-plate-form guide part that guides the card, a fastening part that is fastened to the housing, and a soldered part that is disposed between the guide part and the fastening part, and that is soldered to the circuit board.

In this card connecting structure, when the card is inserted into the card connector, the card is guided by metal guide members disposed on both sides of the housing in the lengthwise direction. Accordingly, the insertion of the card at an inclination can be prevented. Furthermore, the card received in the card connector is fastened to the circuit board by fastening means, enabling the card to be securely fastened. Moreover, since the fastening of the card to the circuit board is accomplished by fastening means that are disposed on the end of the card opposite the contact pads, and the guide members are arranged so that the card is guided by flat-plate-form guide parts, a card connecting structure may have the minimum width capable of satisfying the connector specifications. Space need not be provided on both sides of the card for fastening the card in the connector. Furthermore, the card connector including the guide members is fastened to the circuit board by soldering soldered parts disposed on the guide members to the circuit board, so that the application of an excessive load to the solder-connected parts of the contacts that are solder-connected to the circuit board can be prevented. Here, since the soldered parts are disposed between the flat-plate-form guide parts that guide the card and the fastening parts that are fastened to the housing, the span between the soldered parts and the solder-connected parts of the respective contacts is short, and that the solder-connected parts of the respective contacts can be sufficiently protected.

In an alternative embodiment of the present invention, the card connector comprising a housing which receives one end of the card having contact pads thereon, and contacts which are attached to the housing, and which have contact parts that contact the contact pads of the card and solder-connected parts that are connected by soldering to a circuit board. Metal guide members guide the card and are disposed on both sides of the housing in the lengthwise direction. Each of the guide members comprises a flat-plate-form guide part that guides the card, a fastening part that is fastened to the housing, and a soldered part that is disposed between the guide part and the fastening part, and that is soldered to the circuit board.

This card connector makes it possible to provide a card connector which is suitable for the card connecting structure.

BRIEF DESCRIPTION OF THE DRAWINGS

The invention will now be described by way of example with reference to the accompanying figures of which.

DETAILED DESCRIPTION OF THE PREFERRED EMBODIMENT

Figure 1:
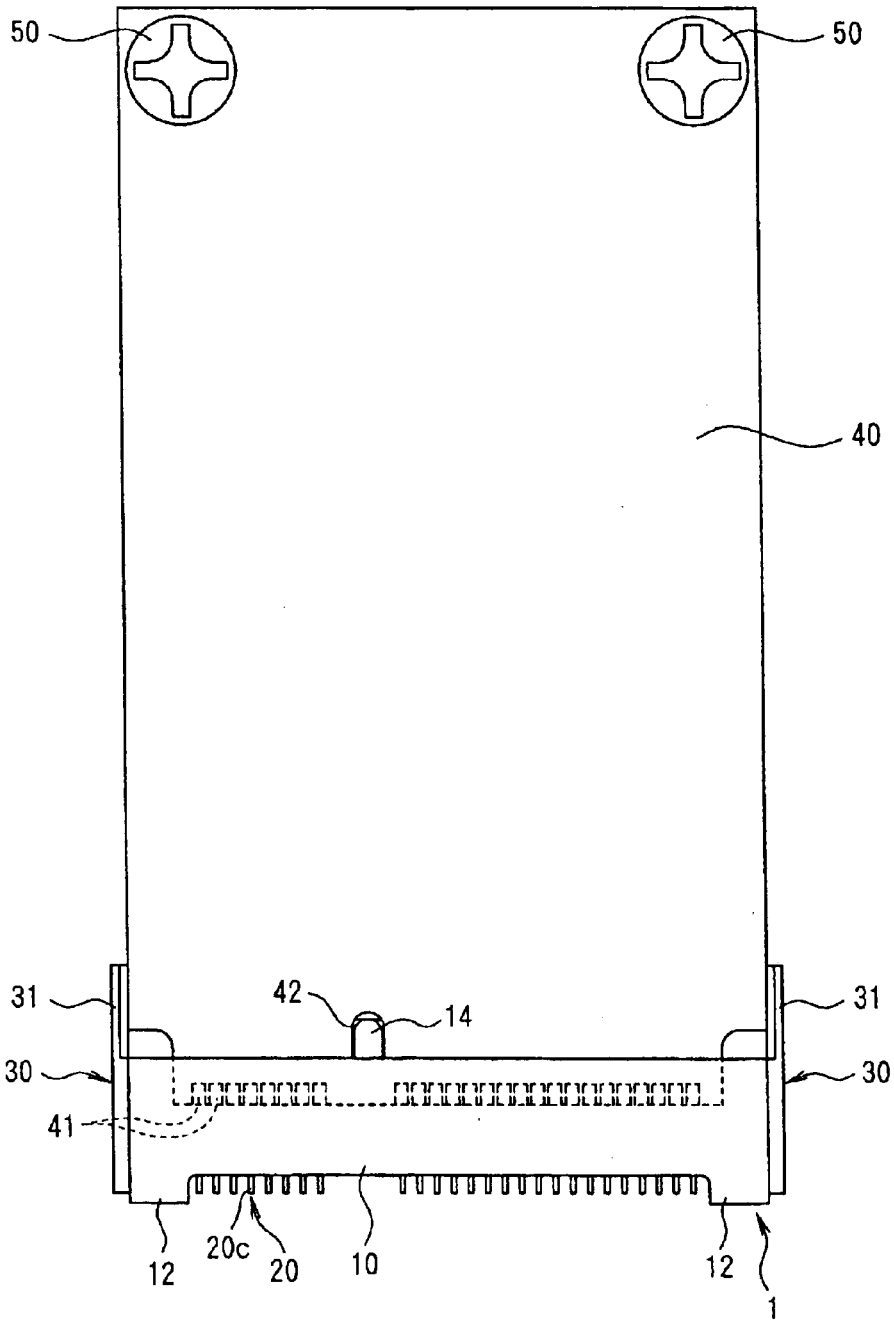
FIG. 1 is a plan view of one embodiment of a card connecting structure according to the present invention.
Figure 2:
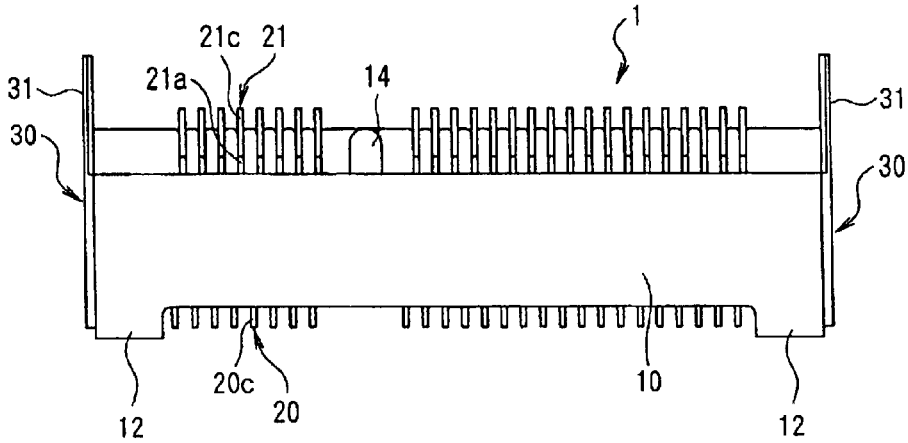
FIGS. 2(A)-2(C) show the card connector used in the card connecting structure shown in FIG. 1, with FIG. 2(A) being a plan view, FIG. 2(B) being a front view, and FIG. 2(C) being a right-side view.
Figure 2:
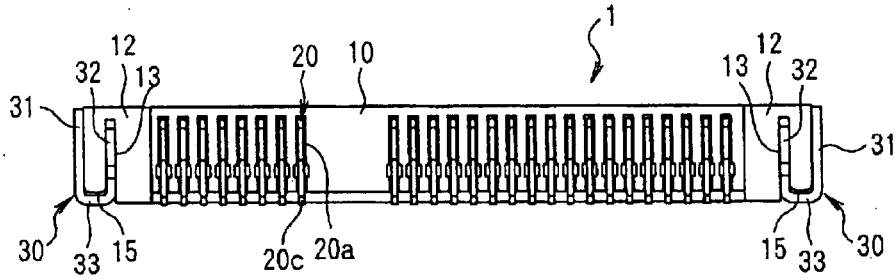
Figure 2:
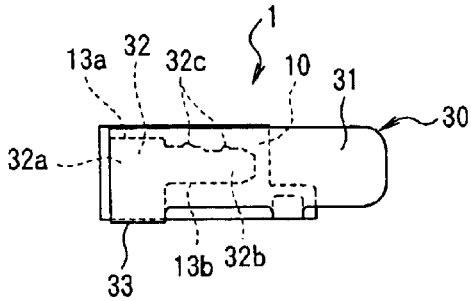
Figure 3:
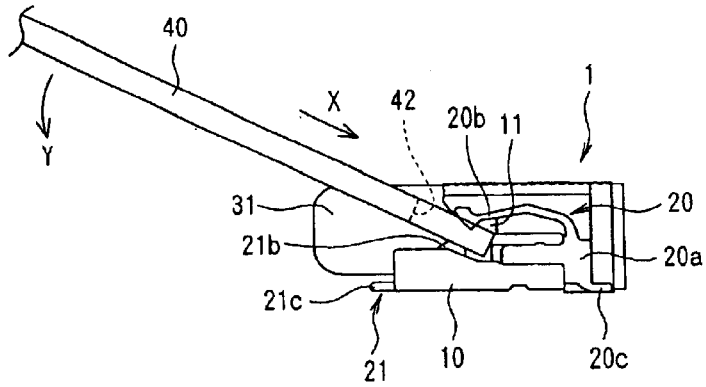
FIG. 3 is a sectional side view used to illustrate the method of insertion of the card into the card connector.
Figure 4:
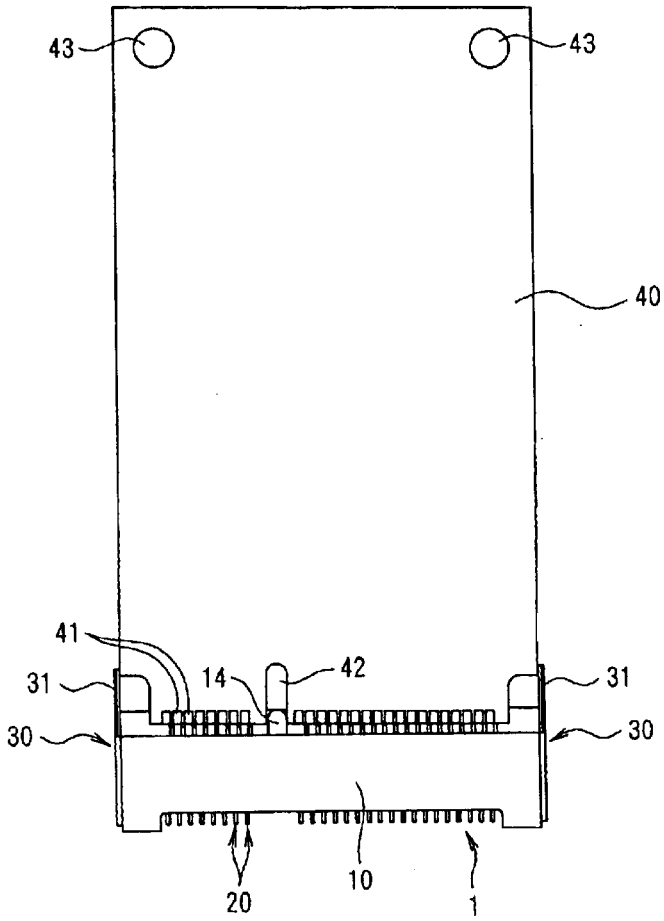
FIG. 4 is a plan view showing the state at an intermediate point in the insertion of the card into the card connector.
Figure 5:
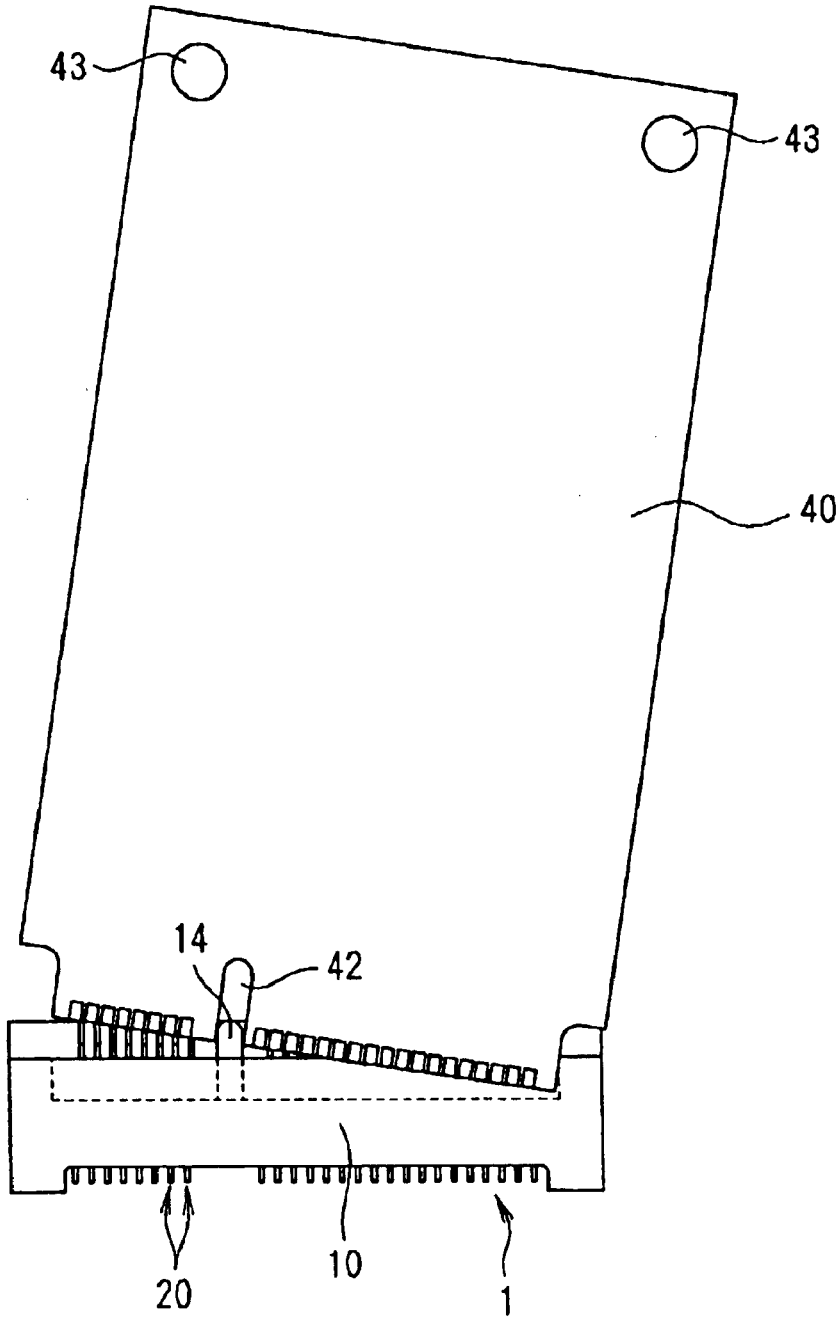
FIG. 5 is a plan view showing the state at an intermediate point in the insertion of the card into a card connector that has no guide members.
Figure 6:
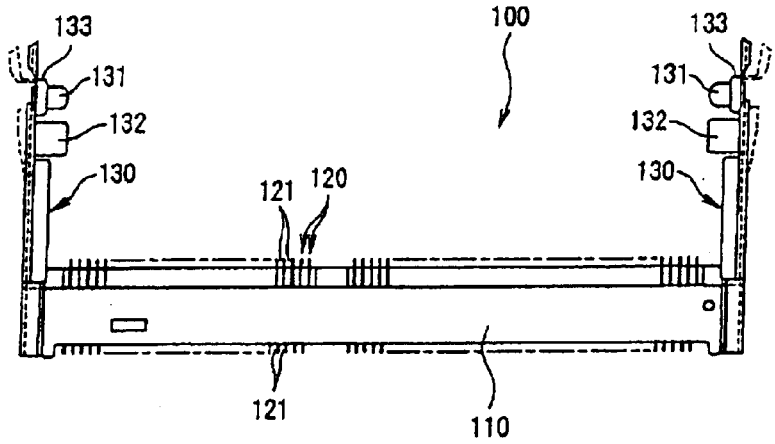
FIGS. 6(A)-6(B) show a conventional example of a card connector, with FIG. 6(A) being a plan view, and FIG. 6(B) being a right-side view showing the card connector along with the inserted card.
Figure 6:
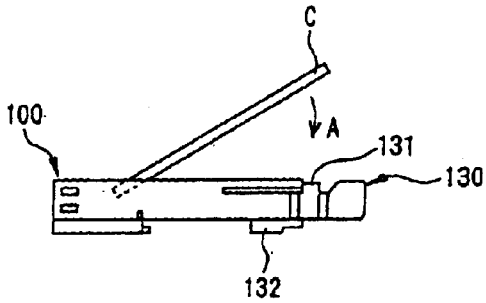
Prior Art FIG. 6 (B)

An exemplary embodiment of the present invention will be described with reference to the figures. FIG. 1 is a plan view which shows one embodiment of the card connecting structure of the present invention. FIG. 2 shows the card connector used in the card connecting structure shown in FIG. 1, with FIG. 2(A) being a plan view, FIG. 2(B) being a front view, and FIG. 2(C) being a right-side view. FIG. 3 is a sectional side view used to illustrate the method of insertion of the card into the card connector. FIG. 4 is a plan view showing the state at an intermediate point in the insertion of the card into the card connector. FIG. 5 is a plan view showing the state at an intermediate point in the insertion of the card into a card connector that has no guide members.

As is shown in FIG. 1, the card connecting structure comprises a card 40 which has a plurality of contact pads 41 on one end, and a card connector 1 which is mounted on a circuit board (not shown in the figures), and which receives the end of the card 40.

Here, as is shown in FIG. 2, the card connector 1 comprises an insulating housing 10 which extends lengthwise (the left-right direction in FIG. 2(A)), a plurality of contacts 20 and 21 which are attached to the housing 10 in two rows, and a pair of metal guide members 30 which are disposed on both sides (one on each side) of the housing 10 in the lengthwise direction, and extending parallel to the direction of insertion of the card 40 into the card connector 1.

As is shown most clearly in FIG. 3, the housing 10 has a card receiving recess 11 extending in the lengthwise direction, which opens on the front side of the housing 10 (i.e., the left side in FIG. 3), and which receives one end of the card 40 having contact pads 41. As is shown in FIG. 2, a pair of guide member fastening parts 12 are disposed on both sides (one on each side) of the housing 10 in the lengthwise direction. These fastening parts 12 fasten the guide members 30 to the housing 10. Press-fitting recesses 13 are formed in the respective guide member fastening parts 12 for receiving the guide members 30. As is shown in FIG. 2(C), each of these press-fitting recesses 13 comprises a rectangular slit 13*a* which extends forward from the rear surface of the guide member fastening part 12, and which opens in the undersurface of the guide member fastening part 12, and a rectangular slit 13*b* which extends forward from this rectangular slit 13*a*, and which has a narrower width in the vertical direction and a longer length in the direction of extension than the slit 13*a*. A soldered-part recess 15 which extends from the lower end of the slit 13*a* of the press-fitting recess 13 toward both outside surfaces of the guide member fastening part 12 is formed in each guide member fastening part 12. Moreover, to prevent insertion of the card 40 in a reverse orientation (i.e., upside-down), a projection 14 is formed on the front side of the card receiving recess 11 of the housing 10, slightly to the left of center with respect to the lengthwise direction as seen from above. The housing 10 may be formed, for example, by molding an insulating synthetic resin.

Furthermore, as is shown in FIGS. 2 and 3, the two rows of contacts 20 and 21 are formed by rear-side contacts 20 which are press-fitted to the housing 10 from the rear side of the housing 10, and front-side contacts 21 which are press-fitted to the housing 10 from the front side of the housing 10. The rear-side contacts 20 and front-side contacts 21 are disposed in a staggered arrangement along the lengthwise direction. Here, as is shown most clearly in FIG. 3, each of the rear-side contacts 20 (among the two rows of contacts 20 and 21) comprises a fastening part 20*a* which is press-fitted from the rear side of the housing 10, a contact part 20*b* which extends from the fastening part 20*a* toward the inside of the card receiving recess 11, and which elastically contacts one of the contact pads 41 on the upper surface of the card 40, and a solder-connected part 20*c* which extends rearward toward the rear side of the housing 10 from the fastening part 20*a*. This solder-connected part 20*c* is connected by soldering to one of the contact pads (not shown in the figures) on the circuit board on which the card connector 1 is mounted. Meanwhile, each of the front-side contacts 21 comprises a fastening part 21*a* which is press-fitted from the front side of the housing 10, a contact part 21*b* which extends from the fastening part 20*a* toward the inside of the card receiving recess 11, and which elastically contacts one of the contact pads 41 on the undersurface of the card 40, and a solder-connected part 21*c* which extends forward toward the front side of the housing 10 from the fastening part 21*a*. This solder-connected part 21*c* is connected by soldering to one of the contact pads (not shown in the figures) on the circuit board on which the card connector 1 is mounted. The rear-side contacts 20 and front-side contacts 21 are formed by stamping metal plates.

Furthermore, the pair of guide members 30 that are disposed on both sides (one on each side) of the housing 10 in the lengthwise direction have shapes that are symmetrical with respect to the center of the card connector 1 in the lengthwisee direction. Moreover, each guide member 30 comprises a flat-plate-form guide part 31 which guides the card 40, a fastening part 32 which is fastened to the corresponding guide member fastening part 12 of the housing 10, and a soldered part 33 which is disposed between the guide part 31 and the fastening part 32, and which is soldered to the circuit board. The respective guide members 30 may be formed by stamping and bending metal plates. Each guide part 31 has a substantially rectangular shape that extends forward along one side surface of the housing 10 in the lengthwise direction when the guide member 30 is attached to the housing 10. The front end of each guide part 31 protrudes slightly further forward than the front end of the housing 10. Furthermore, each fastening part 32 comprises a rectangular base part 32*a* which is inserted into the slit 13*a* of the corresponding press-fitting recess 13 from the rear of the housing 10, and a press-fitting part 32*b* which extends forward from the base part 32*a*, and which has a barb 32*c* on the upper edge and is press-fitted in the slit 13*b* of the press-fitting recess 13. Furthermore, the soldered part 33 extends toward the outside from the lower end of the base part 32*a* by approximately the same width as the base part 32*a*, and is connected to the lower end of the guide part 31. This soldered part 33 is arranged so that the soldered part 33 is positioned in the soldered-part recess 15 of the guide member fastening part 12 when the corresponding guide member 30 is attached to the housing 10, and so that the undersurface of the soldered part 33 is connected by soldering to the circuit board. When the soldered parts 33 are soldered to the circuit board, the card connector 1 including the guide members 30 is fastened to the circuit board, preventing the application of an excessive load to the solder-connected parts 20*b* and 21*b* of the contacts 20 and 21 that are connected by soldering to the circuit board.

As is shown most clearly in FIG. 4, the card 40 has a substantially flat-plate-form shape with a width which is such that the card is guided by the guide parts 31 of the guide members 30 that are disposed on both sides of the housing 10 in the lengthwise direction, and this card 40 has a plurality of contact pads 41 on the upper surface and undersurface at one end. Furthermore, a cut-out 42 into which the projection 14 formed on the housing 10 enters when one end of the card 40 is inserted into the card receiving recess 11 is formed on the end of the card 40 slightly to the left of the center (in the lengthwise direction) as seen from above. Moreover, a plurality of through-holes 43 (two through-holes in the present embodiment) through which the screw parts (not shown in the figures) of the screw members 50 shown in FIG. 1 are passed are formed in the opposite end of the card 40 from the end described above. The screw members 50 fasten the card 40 received in the card connector 1 to the circuit board.

Next, the method for connecting the card 40 to the circuit board will be described with reference to FIGS. 3, 4 and 1.

First, as is shown in FIG. 3, with the card connector 1 mounted on the circuit board, the card 40 is inclined, and is caused to advance in the direction indicated by arrow X so that one end of the card 40 is inserted into the card receiving recess 11 of the housing 10. As a result, the contact parts 20*b* of the rear-side contacts 20 contact the contact pads 41 formed on the upper surface of the card 40, and the contact parts 21*b* of the front-side contacts 21 contact the contact pads 41 formed on the undersurface of the card 40, so that the card 40 and the circuit board are electrically connected. When the card 40 is inserted, the projection 14 formed on the housing 10 enters the cut-out 42 formed in the card 40. If the card 40 is inserted upside down at the time of insertion of the card 40, the projection 14 will not enter the cut-out 42 (since the projection 14 and cut-out 42 are formed so that the positions of these parts are shifted from the center with respect to the direction of length); accordingly, reversed insertion of the card 40 is prevented.

When one end of the card 40 is thus inserted into the card receiving recess 11, both side surfaces of the card 40 are guided by the guide parts 31 of the guide members 30 disposed on both sides of the housing 10 in the lengthwise direction, as shown in FIG. 4. Accordingly, the insertion of the card 40 at an angle (as shown in FIG. 5) can be prevented.

Furthermore, after one end of the card 40 has been inserted into the card receiving recess 11 the card 40 is rotated in the direction indicated by arrow Y in FIG. 3 until the card 40 is substantially parallel to the circuit board. Afterward, the screw parts of the screw members 50 are passed through the through-holes 43 formed in the other end of the card 40 as shown in FIG. 1, and the card 40 is fastened to the circuit board, completing the connection of the card 40 to the circuit board.

When the card 40 is fastened to the circuit board, the insertion of the card 40 at an angle is prevented by the guide members 30. Accordingly, there is no skewing of the card 40 with respect to the card connector 1 as shown in FIG. 5. Consequently, damage to the contact parts 20*b* and 21*b* of the respective contacts 20 and 21 can be avoided, and the respective contact parts 20*b* and 21*b* can be protected.

Since the fastening of the card 40 to the circuit board is accomplished by means of the screw members 50 (fastening means) disposed on the other end of the card 40 from the contact pads 41, and since the guide members 30 guide the card 40 by means of the flat-plate-form guide parts 31, it is possible to obtain a card connecting structure with a minimum width that can be used on a circuit board in which no space is provided for fastening on both sides of the card 40.

Also, the card connector 1 is fastened to the circuit board by soldering the soldered parts 33 disposed on the guide members 30 to the circuit board. These solder connections, due to their area and proximity to the solder-connected parts 20*c* and 21*c*, can carry stresses induced by insertion forces, vibrations, and the like, so that the application of an excessive load to the solder joints connecting the solder-connected parts 20*c* and 21*c* of the contacts 20 and 21 to the circuit board is prevented. Here, since the soldered parts 33 are disposed between the flat-plate-form guide parts 31 that guide the card 40 and the fastening parts 32 that are fastened to the housing 10, the span between the soldered parts 33 and the solder-connected parts 20*c* and 21*c* of the respective contacts 20 and 21 is short, and the solder-connected parts 20*c* and 21*c* of the respective contacts 20 and 21 can be sufficiently protected.

An embodiment of the present invention has been described above. However, the present invention is not limited to this embodiment; various alterations and modifications may be made.

For example, as long as the fastening means can fasten the card 40 received in the card connector 1 to the circuit board, these fastening means are not limited to the screw members 50.

What is claimed is:

1. A card connecting structure comprising:

a card having contact pads on one end thereof;

a card connector mounted on a circuit board and having a housing to receive the one end of the card having contact pads thereon, contacts attached to the housing and having contact parts for contacting the contact pads of the card and solder-connected parts soldered to the circuit board on which the card connector is mounted, and metal guide members disposed on both sides of the housing in the lengthwise direction to guide the card; and fastening means disposed on the card at an end thereof opposite the contact pads for fastening the card to the circuit board;

each of the guide members having a flat-plate-form guide part that guides the card, a fastening part that is fastened to the housing, and a soldered part that is disposed between the guide part and the fastening part and soldered to the circuit board.

2. The card connecting structure of claim 1 wherein the fastening means is a screw.

3. The card connecting structure of claim 1 wherein the card has a slot in the one end having contact pads thereon and the housing includes a projection disposed to engage the slot.

4. The card connecting structure of claim 3 wherein the projection is off-center of the housing to prevent reverse insertion.

5. The card connecting structure of claim 1 wherein the fastening part and the soldered part of the guide members do not extend beyond the housing.

6. The card connecting structure of claim 1 wherein the housing has a press-fitting recess at each end and each fastening part includes a press-fitting part with a barb for press-fitting into the press-fitting recess.

7. A card connector which receives one end of a card having contact pads thereon, the card connector comprising:

a housing with a recess for receiving the one end of the card with contact pads thereon;

contacts attached to the housing, and having contact parts that contact the contact pads of the card and solder-connected parts that are soldered to a circuit board, and metal guide members fastened on both sides of the housing in the lengthwise direction for guiding the card into the recess;

each of the guide members having a flat-plate-form guide part that guides the card, a fastening part that is fastened to the housing, and a soldered part that is disposed between the guide part and the fastening part, and soldered to the circuit board.

8. The card connector of claim 7 wherein the housing has a soldered part recess at each end thereof for receiving the soldered part of the respective guide member.

9. The card connector of claim 7 wherein the guide members are press-fit into the housing.

10. The card connector of claim 9 wherein the housing has a press-fitting recess at each end and each fastening part includes a press-fitting part with a barb for press-fitting into the press-fitting recess.

11. The card connector of claim 7 further comprising a protrusion extending from and off-center of the housing for preventing a card from being inserted in a reverse orientation.

12. A card connecting structure comprising:

a card having contact pads on one end thereof;

a card connector mounted on a circuit board and having a housing to receive the one end of the card having contact pads thereon, contacts attached to the housing and having contact parts for contacting the contact pads of the card and solder-connected parts soldered to the circuit board on which the card connector is mounted, and metal guide members disposed on both sides of the housing in the lengthwise direction to guide the card; and fastening means disposed on the card at an end thereof opposite the contact pads for fastening the card to the circuit board;

each of the guide members having a flat-plate-form guide part that guides the card, a fastening part that is fastened to the housing, and a soldered part that is disposed between the guide part and the fastening part and soldered to the circuit board, wherein the soldering part interconnects the guide part and the fastening part, forming a U-shaped structure.

* * * * *